US005239714A

United States Patent [19]

Huang

[11] Patent Number: 5,239,714

[45] Date of Patent: Aug. 31, 1993

[54] PLAYPEN STRUCTURE

[76] Inventor: Ming T. Huang, 4th Fl., No. 302, Pai Ling Wu Rd., Taipei, Taiwan

[21] Appl. No.: 928,997

[22] Filed: Aug. 12, 1992

[51] Int. Cl.[5] ..... A47D 13/06

[52] U.S. Cl. ..... 5/99.1; 5/98.1

[58] Field of Search ..... 5/98.1, 98.3, 99.1

[56] References Cited

U.S. PATENT DOCUMENTS

| | | | |
|---|---|---|---|
| 4,376,318 | 3/1983 | Cirillo | 5/99.1 |
| 4,688,280 | 8/1987 | Kohus et al. | 5/99.1 |
| 4,811,437 | 3/1989 | Dillner et al. | 5/99.1 |
| 4,934,025 | 6/1990 | Mariol | 5/99.1 X |
| 4,985,948 | 1/1991 | Mariol | 5/99.1 |

*Primary Examiner*—Michael F. Trettel

*Attorney, Agent, or Firm*—Merchant Gould Smith Edell Welter & Schmidt

[57] ABSTRACT

A playpen structure employing a plurality of improved joints. The playpen structure has four pairs of rails. Rails of each pair are joined together by means of a first joint. Each pair of rails is joined to an adjacent pair of rails by means of a second joint. Each of four columns is attached to a corresponding second joint at a first end and attached to one of four feet at a second end. Each of four bars is attached to a corresponding foot at a first end and attached to a third joint at a second end. The third joint joins the bars together, which extend radially therefrom to form a frame of a floor. An auxiliary foot retractably extends from the third joint for supporting the bars.

4 Claims, 5 Drawing Sheets

PLAYPEN STRUCTURE

BACKGROUND OF THE INVENTION

The present invention relates to a playpen structure and, more particularly, to joints for connecting segments of a playpen structure.

Conventionally, a floor of a playpen is made from four bars defining a horizontal rectangle and a board mounted on the bars. When carrying a child, the central portion of the floor tends to sink as no support is provided beneath it. This may cause discomfort for the child. Therefore, this invention is intended to solve the above-mentioned problem.

SUMMARY OF THE INVENTION

It is an object of the present invention to provide a playpen structure employing four radial bars forming a frame of a floor.

It is another object of the present invention to provide a joint for joining together four bars forming a frame of a floor.

It is yet another object of the present invention to provide a retractable auxiliary foot for supporting four bars joined together by means of a joint from which the retractable auxiliary foot extends.

For a better understanding of the present invention and objects thereof, a study of the detailed description of the embodiments described hereinafter should be made in relation to the accompanying drawings.

DETAILED DESCRIPTION OF THE PREFERRED EMBODIMENT

Figure 1:
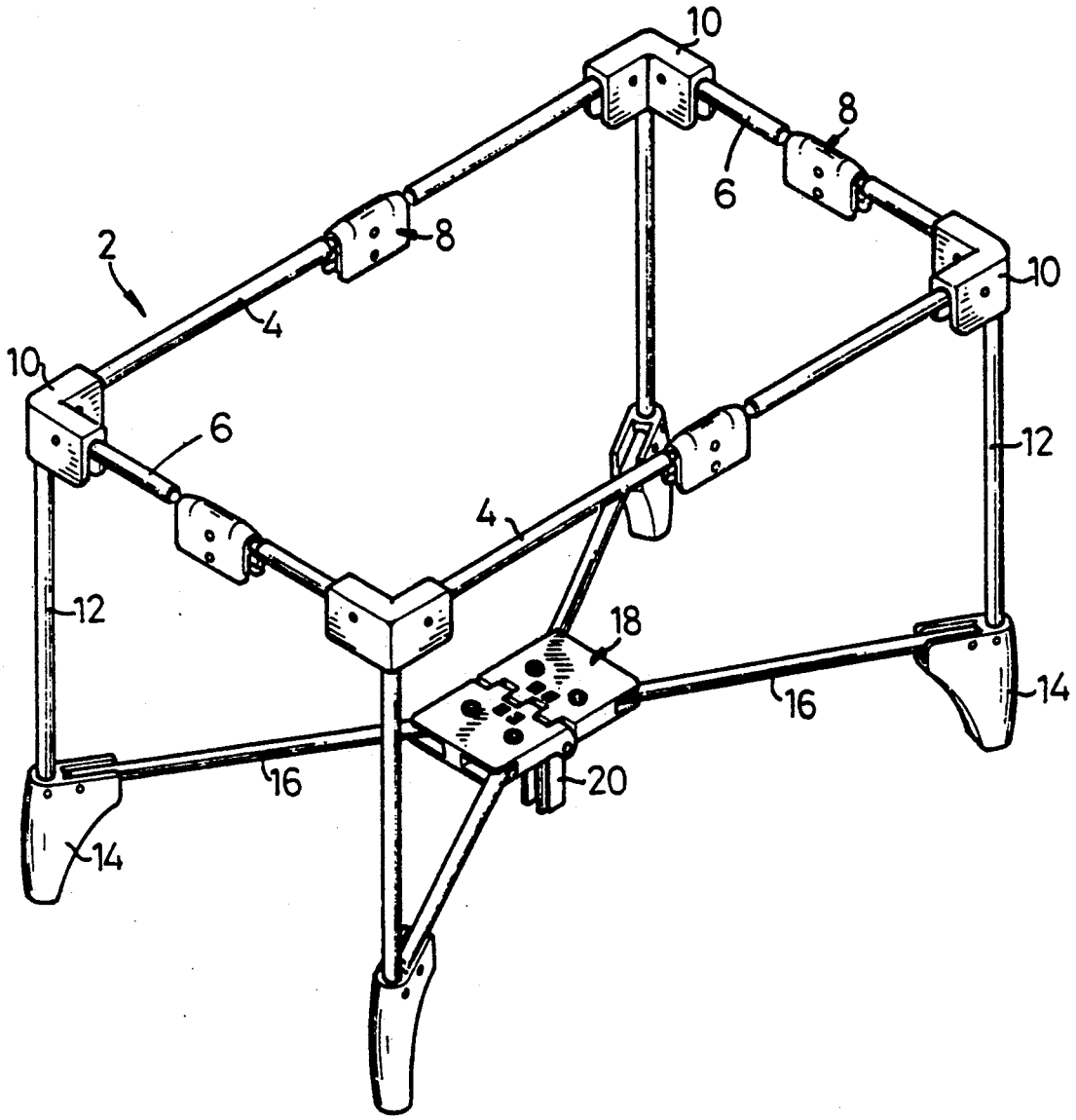
FIG. 1 is a perspective view of a playpen structure in accordance with the present invention.

Referring to the drawings and, more particularly, to FIG. 1, a playpen structure 2 consists cf a plurality of tubular segments and joints. The tubular segments include two pairs of rails 4 and two pairs of rails 6. Two rails 4 of each pair are joined to each other by means of one of four joints 8. Two rails 6 of each pair are joined to each other by means of a corresponding joint 8. Each rail 4 is joined to a corresponding rail 6 by means of one of four joints 10. Thus, the two pairs of rails 4 and the two pairs of rails 6 define a rectangle when completely extended.

In operation, the rectangle defined by the rails 4 and 6 is retained horizontal. Each of four columns 12 is attached to a corresponding joint 10 at a first end thereof and is attached to a corresponding one of four feet 14 at a second end thereof. The four columns 12 are retained vertical.

Each of four bars 16 is attached to a corresponding feet 14 at a first end thereof. The second ends of the bars 16 are joined to each other by means of a joint 18. In operation, the bars 16 radially extend from the joint 18 forming a frame for a floor of the playpen structure 2. An auxiliary foot 20 extends from the joint 18 for supporting the floor.

The detailed description of each joint 10 will not be given as it is conventional. However, the detailed description of each joint 8 will be given with relation to FIGS. 2, 3 and 4. The detailed description of the joint 18 will be given in relation to FIGS. 5, 6 and 7.

Figure 2:
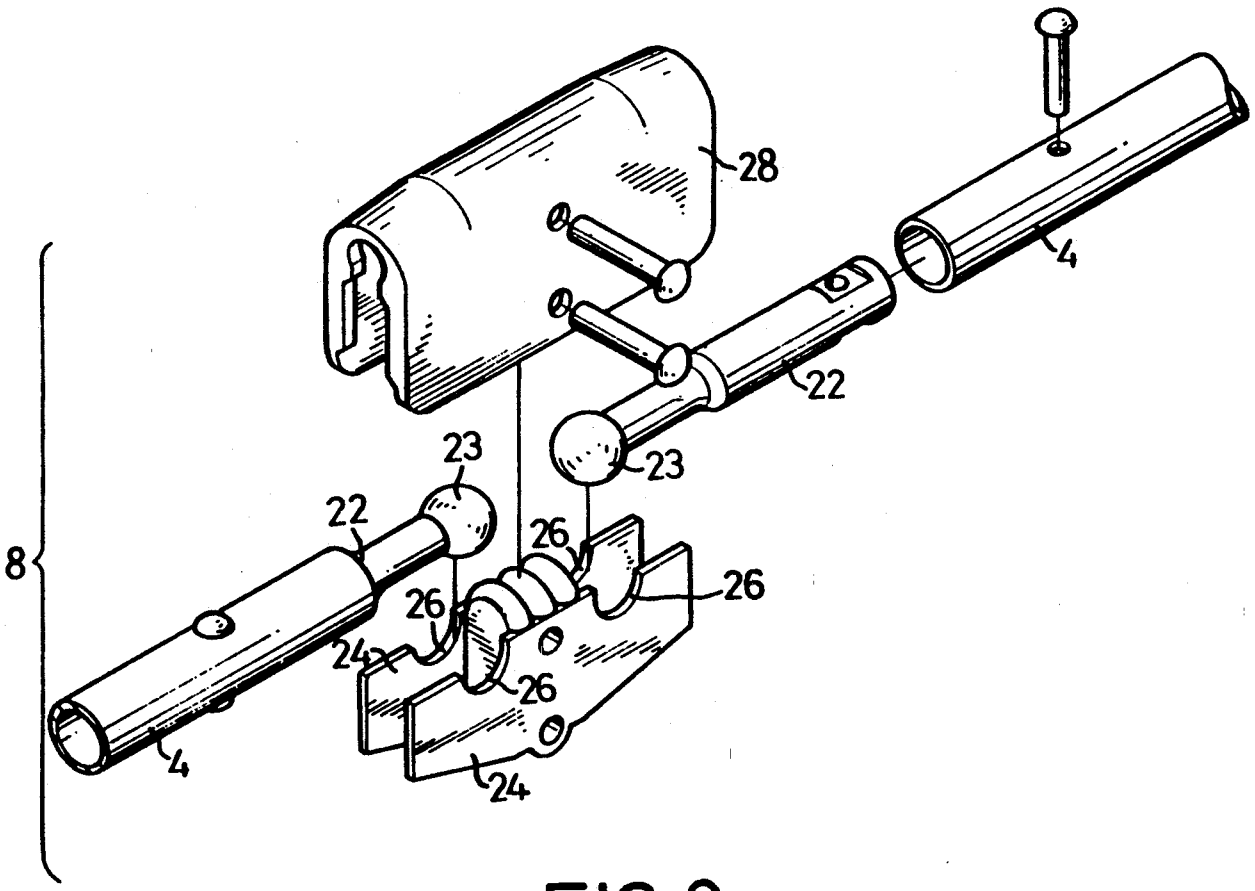
FIG. 2 is an exploded view of a joint for joining two rails in accordance with the present invention.

Referring to FIG. 2, joint 8 is shown in an exploded view. Joint 8 connects one rail 4 with another and connects one rail 6 with another. However, two rails 4 are shown for convenience of illustration. Joint 8 has two poles 22 each having a hole at a first end and a sphere 23 at a second end. A rivet is secured in two holes in a rail 4 and the hole in a pole 22. Thus, the first end of a pole 22 is attached in a rail 4.

Two plates 24 are joined parallel to each other so that the distance therebetween is smaller than the diameter of the sphere 23 of pole 22. An upper edge of each plate 24 has two semi-circular cutoffs, thereby providing two semi-circular concave shoulders 26 having diameters smaller than that of the sphere 23 of pole 22.

A saddle-shaped element 28 has two parallel portions. The sphere 23 of each pole 22 is disposed on a pair of concave shoulders 26 respectively in the plates 24. The saddle-shaped element 28 is secured on the spheres 23 of two poles 22 and the pair of plates 24 by means of two rivets. Thus, joint 8 is assembled.

Figure 3:
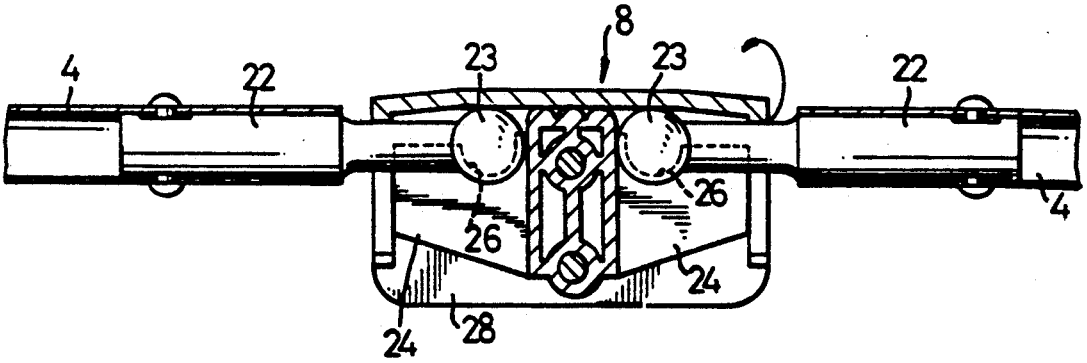
FIG. 3 is a cross-sectional view of a joint for joining two rails when extended in accordance with the present invention.

Referring to FIG. 3, two rails 4 joined to each other by means of joint 8 are shown in an extended position. In operation, the rails 4 are subject to downward loads which are apt to rotate the rails 4 relative to each other. However, the rails 4 are restrained from rotating with respect to each other as a middle portion of the saddle-shaped element 8 is retained above the poles 22.

Figure 4:
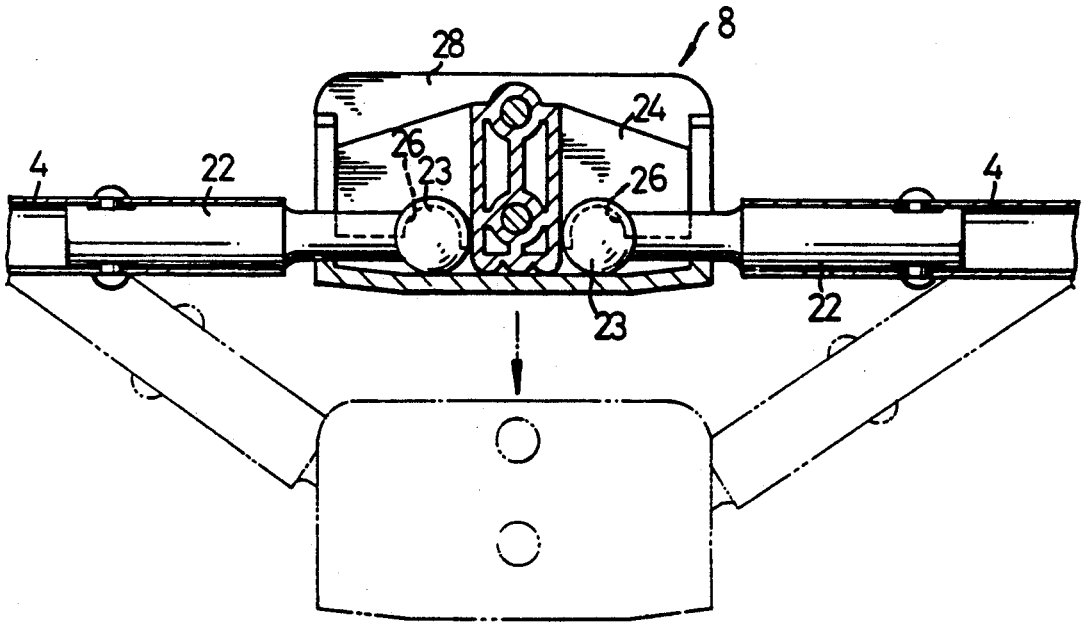
FIG. 4 is a cross-sectional view of a joint for joining two rails when folded in accordance with the present invention.

Referring to FIG. 4, the saddle-shaped element 28 is rotated so that the middle portion thereof is disposed below poles 22. Further referring to FIG. 1, the rails 4 joined by means of a corresponding joint 8 can be moved toward each other and rails 4 and 12 joined by means of a corresponding joint 10 can be moved toward each other. Thus, the playpen structure 2 is ready to be folded.

Figure 5:
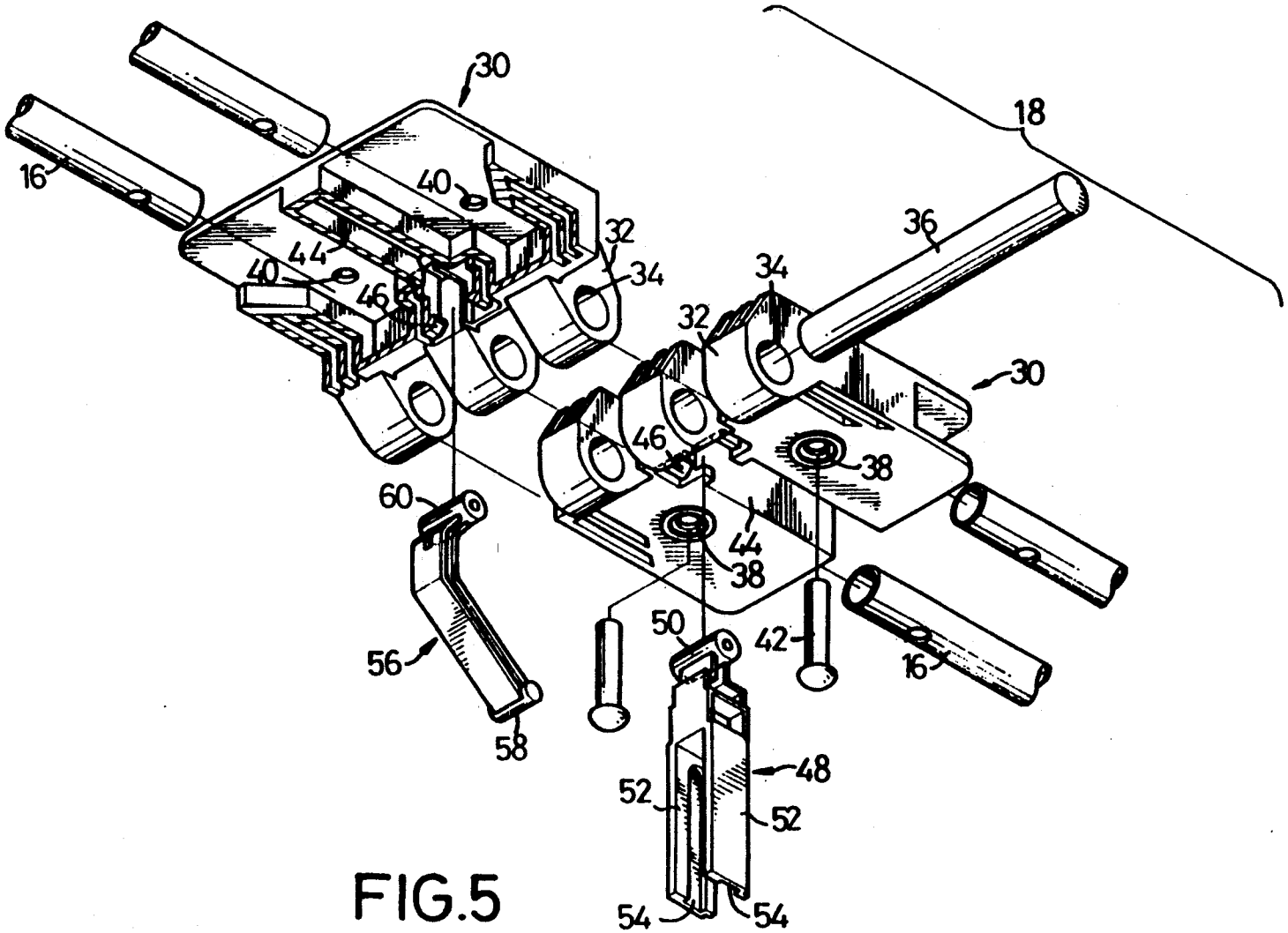
FIG. 5 is an exploded view of a joint for joining four bars in accordance with the present invention.

Referring to FIG. 5, joint 20 has two halves 30. Each half 30 has a wall integrally connecting an upper plate with a lower plate. The wall of each half 30 has three separated lugs 32 so that the lugs 32 of halves 30 can be alternatively disposed beside each other. Each lug 32 has a hole 34. Holes 34 in lugs 32 of each half 30 have a common axis. Thus, a pin 36 can be inserted through holes 34 so that halves 30 are joined to and permitted to pivot with respect to each other.

The upper plate of each half 30 has two holes 38 and the lower plate of the same has two holes 40 corresponding to holes 38. Each of four rivets 42 (only two are shown) is inserted through corresponding holes 38 and 40 and through a hole in a corresponding bar 16 in order to attach each bar 16 to the joint 20. Bars 16 are rotated relative to each other when the joint 20 is switched between its extended and folded positions.

The lower plate of each half 30 defines a T-shaped slot 44 having a first portion extending parallel to the common axis of holes 34 and a second portion extending between holes 40. From the upper plate of the first half 30, two hooks 46 extend within the first portion of the T-shaped slot 44.

An auxiliary foot 48 has a shaft 50 from which two flat prongs 52 transversely extend. The shaft 50 is urged past hooks 46 and disposed between the wall and two shoulders of the first half 30. Thus, the auxiliary foot 48 is permitted to pivot relative to the first half 30. The two prongs 52 extend parallel to each other. Each prong 52 has a longitudinal groove 54. Thus, the two grooves 52 face each other.

A link 56 has a slide 58 at a first end and a shaft 60 at a second end. Two ends of the slide 5 respectively engage with the grooves 54. Thus, the slide 58 is permitted to slide along the grooves 54. The shaft 60 is urged past the hooks 46 and disposed between the wall and two shoulders of the second half 30. Thus, the link 56 is permitted to pivot relative to the second half 30.

Figure 6:
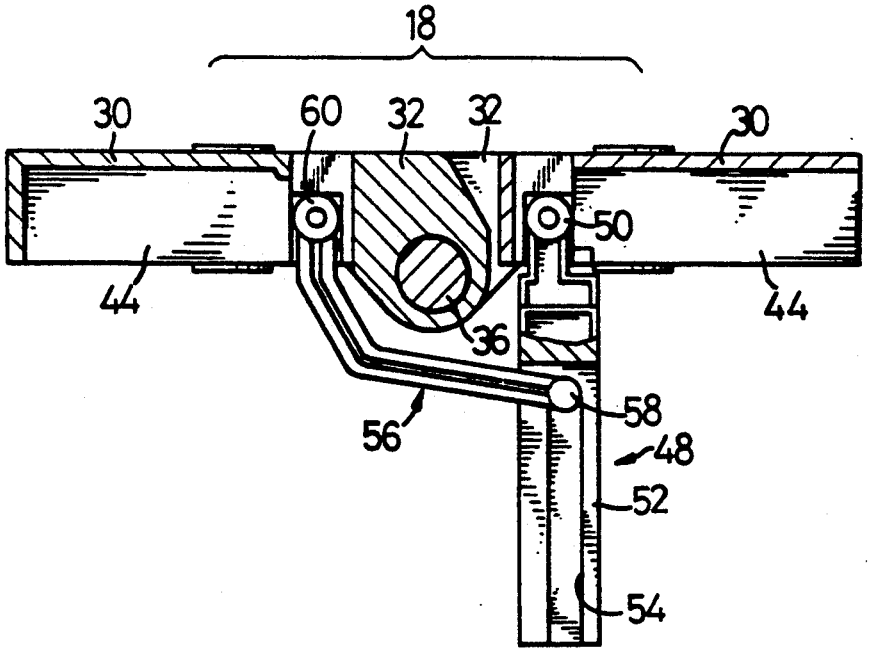
FIG. 6 is a cross-sectional view of a joint for joining four bars when extended in accordance With the present invention.

Referring to FIG. 6, the joint 18 is in its extended position. That is, halves 30 are retained on a horizontal plane. The auxiliary foot 48 is retained vertical. In this position, the playpen structure 2 is ready for operation (see FIG. 1). The auxiliary foot 48 supports bars 16.

Figure 7:
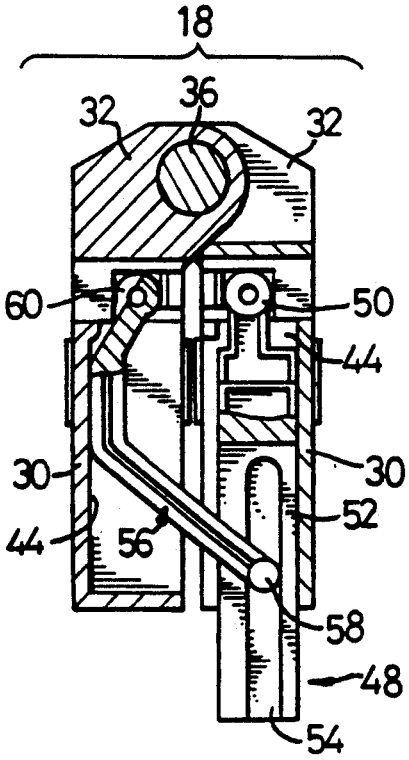
FIG. 7 is a cross-sectional view of a joint for joining four bars when folded in accordance with the present invention.

Referring to FIG. 7, the joint 18 is in its folded position. That is, halves 30 are substantially retained against each other. The slide 58 slides along grooves 54 to a lowest position. The auxiliary foot 48 is urged through T-shaped slot 44 and disposed in the first half 30. The link 56 is urged through T-shaped slot 44 and disposed in the second half 30. In this position, the playpen structure 2 is ready for transportation and storage.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A playpen structure, comprising:

four pairs of rails, wherein said rails of each said pair are joined together by means of a first joint, and each said pair of rails is joined to an adjacent pair of rails by means of a second joint;

four columns each having a first end attached to a corresponding one of the second joint and a second end attached to a corresponding one of four feet;

a floor consisting of (a) four bars respectively pivotally linking to said feet and (b) a third joint comprising two pivotally joined halves wherein one of said halves pivotally links to two of said bars while the remaining of said halves pivotally links to the remaining of said bars; and an auxiliary foot pivotally linking to one of said halves so that said auxiliary foot is retained vertical for supporting said bars when said halves are laid in the same horizontal plane.

2. A playpen structure in accordance with claim 1 further comprising a link having a first end rotatably attached to the remaining said half and a second end slidably attached to said foot.

3. A playpen structure in accordance with claim 2, wherein said foot has two prongs respectively having a longitudinal groove.

4. A playpen structure in accordance with claim 3, wherein said second end of said link has a slide for sliding along said grooves.

* * * * *